US005808560A

United States Patent [19]

Mulanax

[11] Patent Number: 5,808,560

[45] Date of Patent: Sep. 15, 1998

[54] EMERGENCY VEHICLE ALERT APPARATUS

[75] Inventor: Michael L. Mulanax, Las Vegas, Nev.

[73] Assignee: Emergency Alert Technologies Inc., Las Vegas, Nev.

[21] Appl. No.: 664,531

[22] Filed: Jun. 17, 1996

[51] Int. Cl.[6] ..... G08G 1/00

[52] U.S. Cl. ..... 340/902; 340/906; 455/34.1

[58] Field of Search ..... 340/902, 906; 455/34.1, 34.2

[56] References Cited

U.S. PATENT DOCUMENTS

| | | | |
|---|---|---|---|
| 3,710,313 | 1/1973 | Kimball et al. | 340/902 |
| 3,760,349 | 9/1973 | Keister et al. | 340/902 |
| 3,876,940 | 4/1975 | Wickord et al. | 340/902 |
| 3,997,868 | 12/1976 | Ribnick et al. | 340/902 |
| 4,238,778 | 12/1980 | Ohsumi | 340/902 |
| 4,747,064 | 5/1988 | Hohnston | 340/902 |
| 5,235,329 | 8/1993 | Jackson | 340/902 |
| 5,303,259 | 4/1994 | Loveall | 340/902 |
| 5,307,060 | 4/1994 | Prevulsky et al. | 340/902 |

*Primary Examiner*—Jeffery Hofsass
*Assistant Examiner*—Daniel J. Wu
*Attorney, Agent, or Firm*—Red Gallagher

[57] ABSTRACT

A simple and effective apparatus and method is disclosed for identifying the presence of an emergency vehicle in the immediate vicinity of a motor vehicle. This apparatus may be readily mounted and will not produce false alarms. The apparatus comprises: a transmitting unit, positioned within the emergency vehicle and having an activation circuit that turns on a digital identification data encoder that modulates an R.F. transmitter producing a digital data stream which is connected to a broadcast antenna; and, a receiving unit, carried by a motor vehicle so that it may be warned if the emergency vehicle is in its immediate vicinity having and having a R.F. receiver that demodulates a received digital data stream and then activates an alert pulse generator which is connected to an alarm means if the digital identification code matches the digital identification encoded in the transmitting unit. In a preferred aspect of this invention the digital identification data encoder modulates the R.F. transmitter with a data byte containing bits which identify the transmitting unit and the receiving unit comprises a data decoder which doubly checks the received digital data stream so that the alarm means only will be activated when two sequentially received data bytes are identical, thereby virtually eliminating any possibility of false activation of the alarm means.

14 Claims, 4 Drawing Sheets

EMERGENCY VEHICLE ALERT APPARATUS

FIELD OF INVENTION

This invention relates to emergency vehicle alert apparatuses of the type comprising a transmitter in an emergency vehicle and receivers in vehicles to be alerted. More particularly this invention relates to such apparatuses which are configured to trigger an alarm if and only if a broadcast signal is received so that the possibility of false triggering is virtually eliminated.

BACKGROUND OF THE INVENTION

The problem of motorists colliding with an emergency vehicle which may usurp the right of way from intersecting traffic has been addressed by others. One solution posed to this problem is to locally jam radio signals so that vehicles in the immediate vicinity might be aware of the presence of the emergency vehicle. One problem with this approach is that the jamming does not positively identify the presence of an emergency vehicle; the jamming is more than likely caused by something other than the emergency vehicle. Another solution to this problem is to broadcast a message for reception on an adapter wired to a radio in a receiving vehicle. One problem with this approach is that such adapter connection and mounting is elaborate and expensive. If a vehicle does not have a radio which is on then it can not work at all.

OBJECTS AND STATEMENT OF INVENTION

It is an object of this invention to disclose a simple and effective apparatus for identifying the presence of an emergency vehicle. This apparatus may be readily mounted and will not produce false alarms. It is an object of this invention to disclose an emergency vehicle alarm which may be programmed to identify the type of emergency vehicle in the immediate locality. It is a final object of this invention to disclose an emergency vehicle alarm which sounds intermittently only when an emergency vehicle is present within a prescribed immediate range.

One aspect of this invention provides for an apparatus for warning a motor vehicle of an emergency vehicle in the immediate vicinity comprising: a transmitting unit having an activation circuit that turns on a digital identification data encoder that modulates an R.F. transmitter producing a digital data stream which is connected to a broadcast antenna; a receiving unit having a R.F. receiver that demodulates a received digital data stream and then activates an alert pulse generator connected to an alarm means if the digital identification code matches the digital identification encoded in the transmitting unit; wherein use the transmitting unit is positioned within the emergency vehicle and the receiving unit is carried by a motor vehicle so that it may be warned if the emergency vehicle is in its immediate vicinity.

Another aspect of this invention provides for an apparatus as above wherein the digital identification data encoder modulates the R.F. transmitter with a data byte containing bits which identify the transmitting unit and wherein the receiving unit comprises a data decoder which checks the received digital data stream first to determine if it contains a valid data byte by comparing it to a programmed data code inputted to a 1st data comparator; if this data byte matches the programmed data code then it is placed in temporary data storage; then the next data byte is compared at a 2nd data comparator to the temporary data storage, and then finally if the sequential data bytes are identical an output is sent to an alert pulse generator connected to the alarm means so that the alarm means only will be activated when two sequentially received data bytes are identical thereby virtually eliminating any possibility of false activation of the alarm means.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 4:
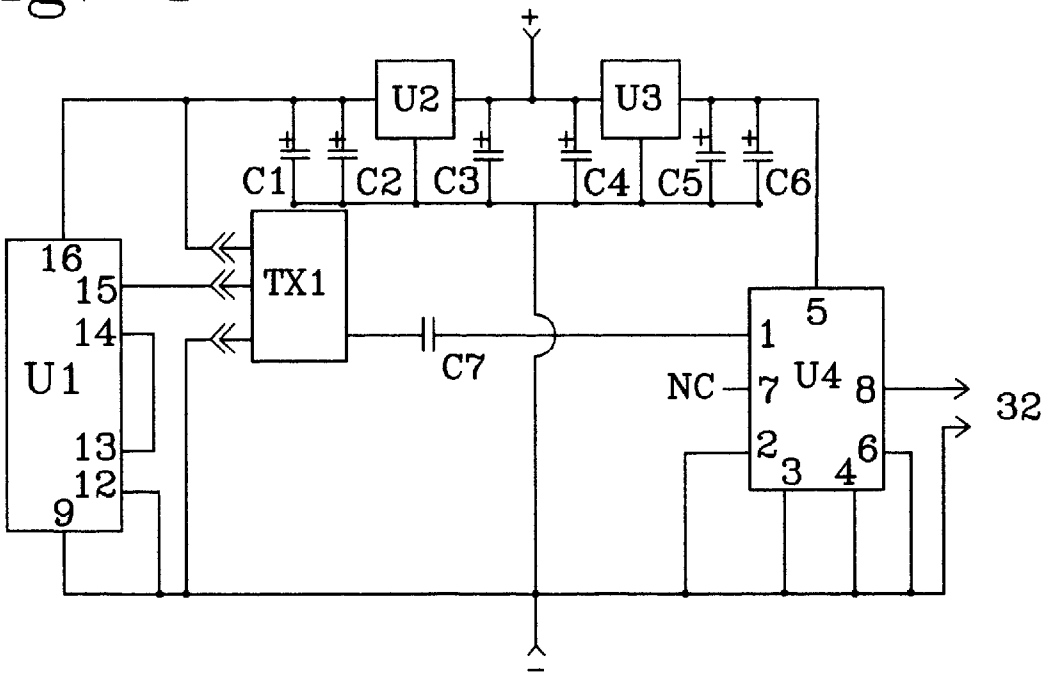
FIG. 4 is a circuit diagram of the transmitting unit.

Table 1 is a table identifying the parts in the transmitting unit shown in FIG. 4.

Table 2 is a table identifying the parts in the receiving unit shown in FIG. 4.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
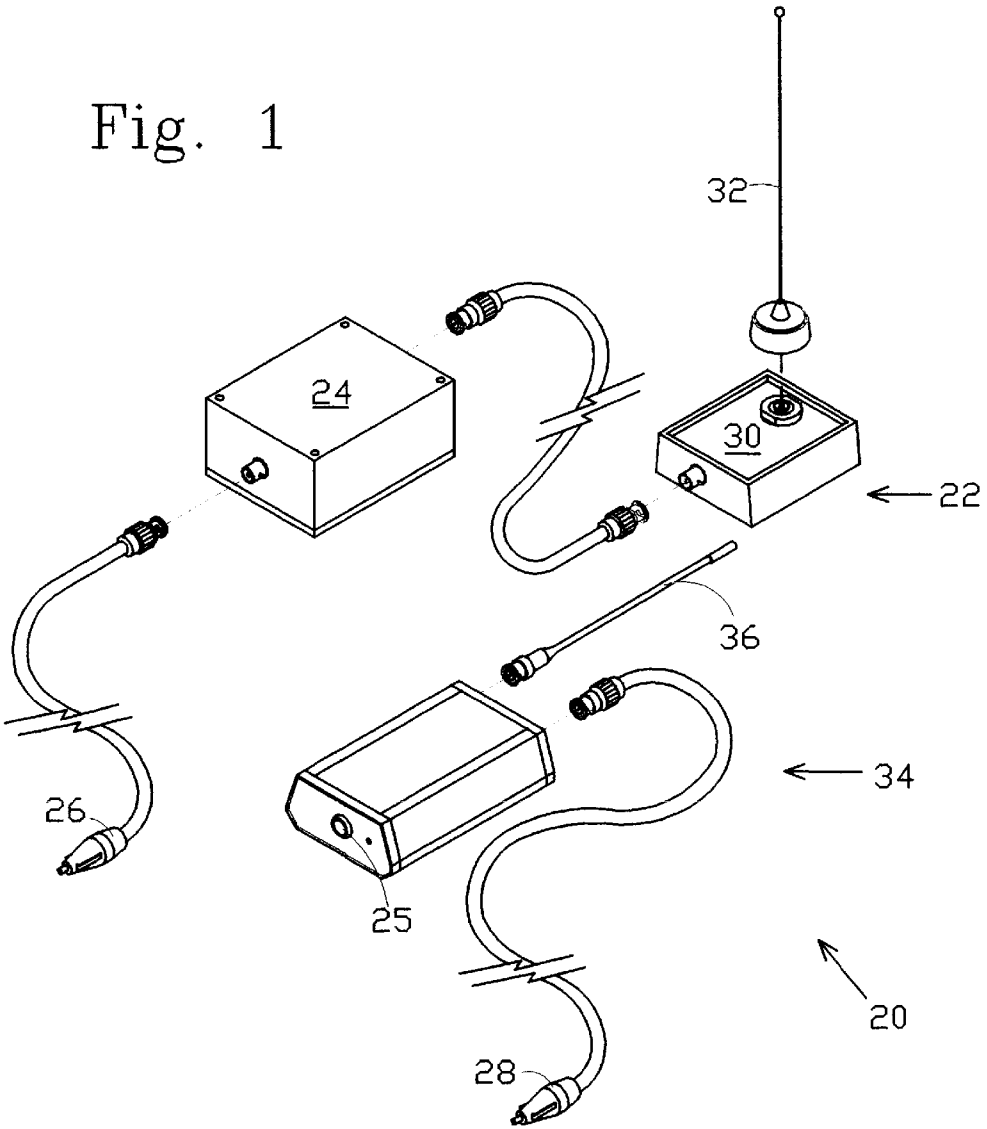
FIG. 1 is a perspective view of an emergency vehicle alert apparatus.

Turning now to the drawings and more particularly to FIG. 1 we have a perspective view of an emergency vehicle alert apparatus 20. The apparatus 20 comprises a two part transmitting unit 22. A larger housing 24, shown fitted with a removable cigarette lighter power connect 26, is adapted to be mounted at a lower level in an emergency vehicle (not shown). Preferably the transmitting unit 22 is electrically connected to the emergency vehicle's siren (not shown) to activate automatically and transmit continuously as long as the siren is operating. The transmitting unit's output power is such as to limit its activation range to the receiving units 34 in motor vehicles in the immediate vicinity which may be affected by the emergency vehicle's movements or location. The larger housing 26, which is aluminum, houses an ACTIVATION CIRCUIT, a DATA ENCODER, and a TRANSMITTER. The larger housing 24 is remotely connected with a cable 28 to a broadcast housing 30 is mounted on an upper level of an emergency vehicle (not shown) so that the broadcast antenna 32 may have an unobstructed exterior view. The apparatus 20 additionally comprises a receiving unit 34. The receiving unit 34 has either a removable reception antenna 36 or an internal antennae (not shown). A removable cigarette lighter power connection cable 26 is provided for quick connection within a motor vehicle (not shown) which may come within the reception range of the transmitter 22 in the emergency vehicle (not shown).

Figure 2:
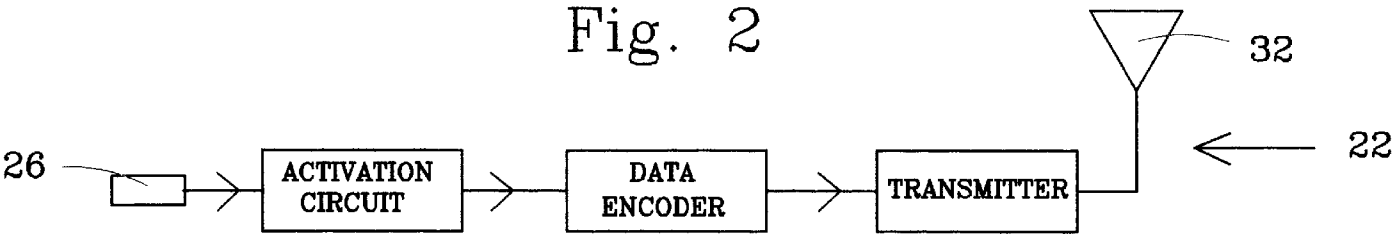
FIG. 2 is a block diagram shoving the operational component blocks of a transmitting unit of the emergency vehicle alert apparatus shown in FIG. 1.

FIG. 2 is a block diagram showing the operational component blocks of a transmitting unit 22 of the emergency vehicle alert apparatus 20 shown in FIG. 1. The apparatus 20 for warning a motor vehicle (not shown) of an emergency vehicle (not shown) in the immediate vicinity comprises: a transmitting unit 22 having an ACTIVATION CIRCUIT that turns on a digital identification DATA ENCODER that modulates a radio frequency (R.F.) TRANSMITTER with a data byte containing bits which identify the transmitting unit to produce a digital data stream which is connected to a broadcast antenna 32.

Figure 3:
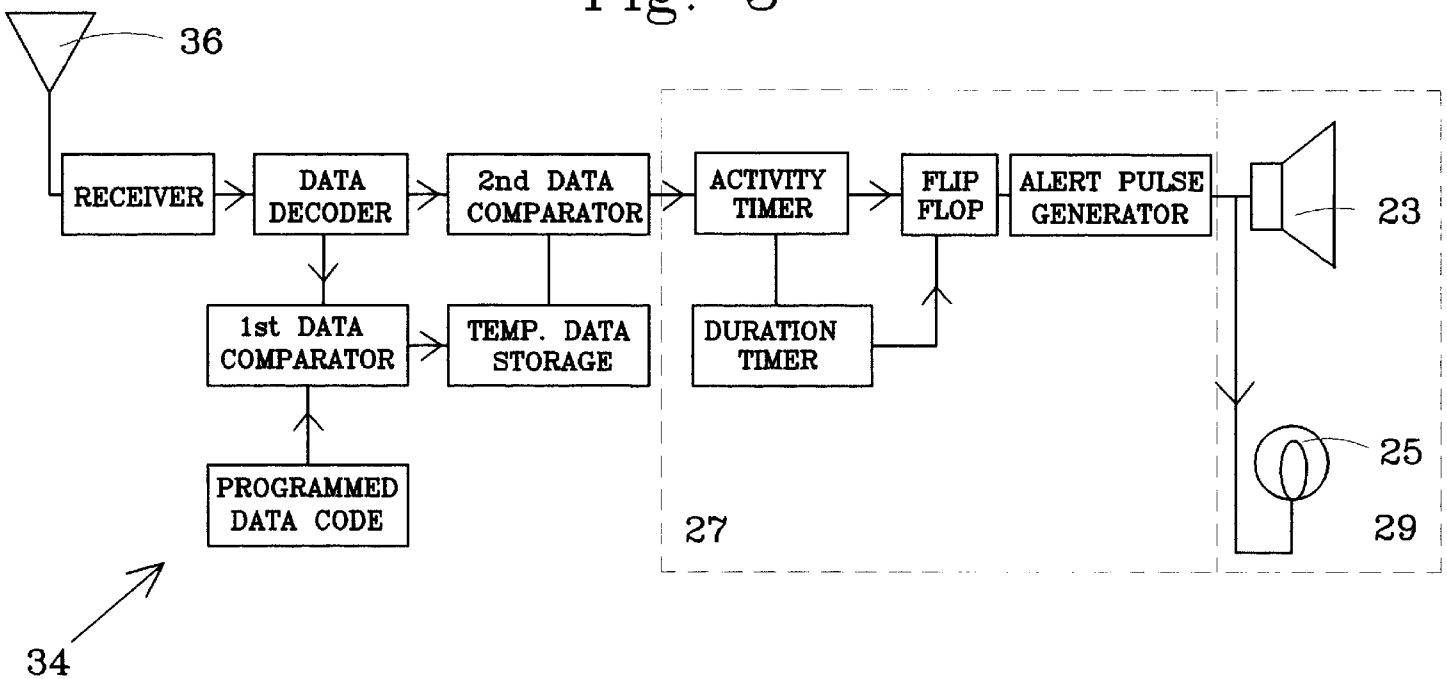
FIG. 3 is a block diagram shoving the operational component blocks in a receiving unit of the emergency vehicle alert apparatus shown in FIG. 1.

FIG. 3 is a block diagram showing the operational component blocks in a receiving unit 34 of the emergency vehicle alert apparatus 20 shown in FIG. 1. The receiving unit 34 having a R.F. RECEIVER demodulates the received digital data stream and then activates an ALERT PULSE GENERATOR connected to an alarm means 29, which preferably is both an audible alarm 23 and a flashing lamp or a LED 25, if the digital identification code matches the digital identification encoded in the transmitting unit 22. The demodulation portion of the receiving unit 34 comprises a DATA DECODER which checks the received digital data stream first to determine if it contains a valid data byte by comparing it to a PROGRAMMED DATA CODE inputted to a 1st DATA COMPARATOR; if this data byte matches the programmed data code then it is placed in TEMP. DATA STORAGE; concurrently the next data byte is compared at a 2nd DATA COMPARATOR to the TEMP. DATA STORAGE, and then finally if the sequential data bytes are identical an output is sent from the 2nd DATA COMPARATOR to an ALERT PULSE GENERATOR connected to the alarm means 29 so that it will only be activated when two sequentially received data bytes are identical. This check of two sequential data bytes virtually eliminates any possibility of false activation of the alarm means 29.

The output of the 2nd DATA COMPARATOR is continuous so long as sequential data bytes match. In the most preferred embodiment of the invention an intermittent alarm control 27 is interposed between the output from the 2nd DATA COMPARATOR and the input side of the ALERT PULSE GENERATOR to avoid a continuous and annoying alarm and prevent the alarm means 29 from continually activating if the receiving unit 34 remains within the immediate vicinity of the emergency vehicle (not shown) for an extended time, by not allowing reactivation until there has not been a valid data stream for a predetermined amount of time. The intermittent alarm control 27 comprises an ACTIVITY TIMER outputting to both to a DURATION TIMER which is a monostable generator and a FLIP FLOP which also receives an input from the DURATION TIMER; said FLIP FLOP in turn outputs to the ALERT PULSE GENERATOR. In use the DURATION TIMER sends a pulse to the FLIP FLOP after a programmed predetermined amount of time to reset the alarm means 29. In the most preferred embodiment the predetermined amount of time for the intermittent reactivation of the alarm means 29 may be programmed independently of the prerequisite duration of a valid data stream so that if the receiving unit 34 remains in the immediate vicinity of an emergency vehicle (not shown) for an extended period of time the alarm may be deactivated for a longer period than the intermittent time.

Figure 5:
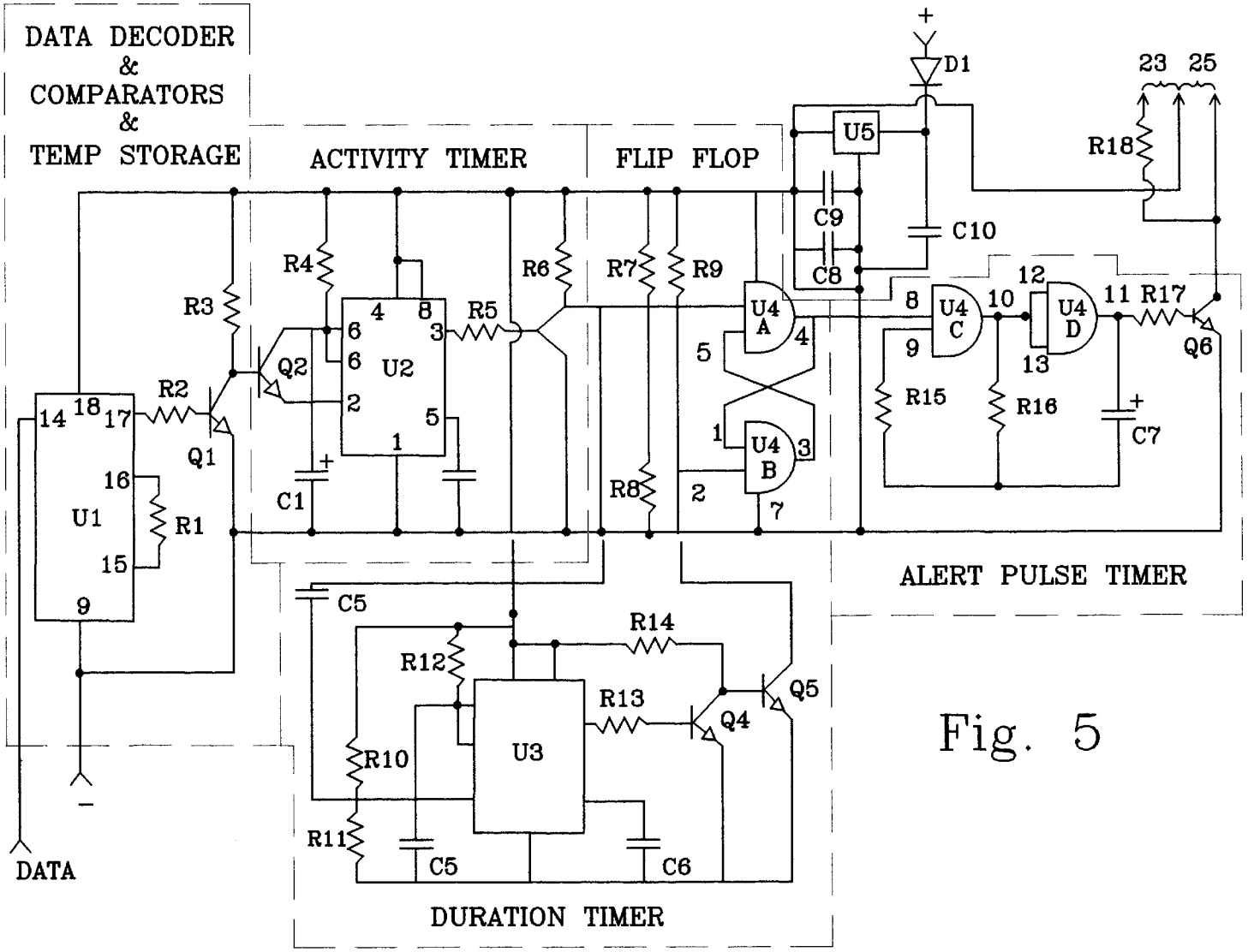
FIG. 5 is a circuit diagram of the receiving unit.

FIG. 4 is a circuit diagram of the transmitting unit 22. FIG. 5 is a circuit diagram of the receiving unit 34. The inputted voltage on both FIGS. 4 and 5 is the vehicle's 12 VDC. On FIG. 5 the input marked DATA is demodulated output from a digital receiver (not shown) having an antennae 36. While a standard digital receiver was used, an AM receiver would also perform suitably. Broken lines marked on FIGS. 3 and 4 encircle portions of the circuits which correspond to the component blocks shown in FIG. 2 and 3 respectively.

Table 1 is a table identifying the parts in the transmitting unit 22 shown in FIG. 4. Table 2 is a table identifying the parts in the receiving unit 34 shown in FIG. 4.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

TABLE 1

| | | | |
|---|---|---|---|
| C1 | 47uf TANTALLUM | R1 | 75K |
| C2 | .1uf TANTALUM | U1 | HT-12E |
| C3 | .1uf TANTALUM | U2 | 78LO5 |
| C4 | .1uf TANTALUM | U3 | 7812 |
| C5 | .1uf TANTALUM | U4 | MAN-1LN |
| C6 | 47uf TANTALUM | | MINI-CIRCUITS AMP |
| C7 | 4pf DISC CERAMIC | TX1 | MING TX-66 TRANSMITTER |

TABLE 2

| | | | |
|---|---|---|---|
| C1 | 4.7uf TANTALLUM | R7 | 1K |
| C2 | .01uf DISC CERAMIC | R8 | 2.2K |
| C3 | .01uf DISC CERAMIC | R9 | 100K |
| C4 | .01uf DISC CERAMIC | R10 | 1K |
| C5 | 4.7uf TANTALLUM | R11 | 2.2K |
| C6 | .01uf DISC CERAMIC | R12 | 1M |
| C7 | 1uf TANTALLUM | R13 | 10K |
| C8 | .1uf TANTALLUM | R14 | 10K |
| C9 | 47uf TANTALLUM | R15 | 1M |
| C10 | .1uf TANTALLUM | R16 | 100K |
| | | R17 | 10K |
| D1 | 1N4002 | R18 | 470 |
| Q1 | 2N3904 | U1 | HT-12F |
| Q2 | 2N3906 | U2 | L555 |
| Q3 | 2N3904 | U3 | L555 |
| Q4 | 2N3904 | U4 | CD4001 |
| Q5 | 2N3904 | U5 | 78L05 |
| Q6 | 2N3904 | RX1 RECEIVER | MING RE-66 |
| R1 | 75K | | |
| R2 | 10K | | |
| R3 | 10K | | |
| R4 | 1M | | |
| R5 | 10K | | |
| R6 | 10K | | |

I claim:

1. An apparatus for warning a motor vehicle of an emergency vehicle in the immediate vicinity comprising:

a transmitting unit having an activation circuit that turns on a digital identification data encoder that modulates an R.F. transmitter producing a digital data stream which is connected to a broadcast antenna;

a receiving unit having a R.F. receiver that demodulates a received digital data stream and then activates an alert pulse generator connected to an alarm means if the digital identification code matches the digital identification encoded in the transmitting unit;

wherein the receiving unit comprises a data decoder which checks the received digital data stream first to determine if it contains a valid data byte by comparing it to a programmed data code inputted to a first data comparator; if this data byte matches the programmed data code then it is placed in temporary data storage; then the next data byte is compared at a second data comparator to the temporary data storage, and then finally if the sequential data bytes are identical an output is sent to an alert pulse generator connected to the alarm means so that the alarm means only will be activated when two sequentially received data bytes are identical thereby virtually eliminating any possibility of false activation of the alarm means; and, wherein use the transmitting unit is positioned within the emergency vehicle and the receiving unit is carried by a motor vehicle so that the motor vehicle is (it may be) warned if the emergency vehicle is in its immediate vicinity.

2. An apparatus as in claim 1 wherein the digital identification data encoder modulates the R.F. transmitter with a data byte containing bits which identify the transmitting unit.

3. An apparatus as in claim 1 wherein the second data comparator outputs to an activity timer as long as sequential data bytes match; said activity timer outputs both to a duration timer and a flip flop which also receives input from the duration timer; said flip flop in turn outputs to the alert pulse generator;

wherein use said duration timer sends a pulse to the flip flop after a programmed predetermined amount of time to reset the alarm means thereby avoiding a continuous annoying alarm and preventing the alarm from continually activating if the receiving unit remains within the immediate vicinity of the emergency vehicle for an extended time, by not allowing reactivation until there has been a valid data stream for a predetermined amount of time.

4. An apparatus as in claim 3 wherein the duration timer is a monostable generator.

5. An apparatus as in claim 4 wherein the alarm means comprises an audible alarm and a flashing lamp.

6. An apparatus as in claim 5 wherein the predetermined amount of time for the intermittent reactivation of the alarm means may be programmed independently of the prerequisite duration of a valid data stream so that if the receiving unit remains in the immediate vicinity of an emergency vehicle for an extended period of time the alarm may be deactivated for a longer period than the intermittent time.

7. An apparatus as in claim 6 wherein the receiving unit is equipped with a cigarette lighter power connection.

8. A method for warning a motor vehicle of an emergency vehicle in the immediate vicinity comprising the following steps:

transmitting a data stream through a transmitting unit having an activation circuit that turns on a digital identification data encoder that modulates an R.F. transmitter producing a digital data stream which is connected to a broadcast antenna;

receiving the data stream through a receiving unit having a R.F. receiver that demodulates a received digital data stream and then activates an alert pulse generator connected to an alarm means if the digital identification code matches the digital identification encoded in the transmitting unit;

wherein the receiving unit comprises a data decoder which checks the received digital data stream first to determine if it contains a valid data byte by comparing it to a programmed data code inputted to a first data comparator; if this data byte matches the programmed data code then it is placed in temporary data storage; then the next data byte is compared at a second data comparator to the temporary data storage, and then finally if the sequential data bytes are identical an output is sent to an alert pulse generator connected to the alarm means so that the alarm means only will be activated when two sequentially received data bytes are identical thereby virtually eliminating any possibility of false activation of the alarm means; and, wherein use the transmitting unit is positioned within the emergency vehicle and the receiving unit is carried by a motor vehicle so that the motor vehicle is warned if the emergency vehicle is in its immediate vicinity.

9. A method as in claim 8 wherein the digital identification data encoder modulates the R.F. transmitter with a data byte containing bits which identify the transmitting unit.

10. A method as in claim 8 wherein the second data comparator outputs to an activity timer as long as sequential data bytes match; said activity timer outputs both to a duration timer and a flip flop which also receives input from the duration timer; said flip flop in turn outputs to the alert pulse generator;

wherein use said duration timer sends a pulse to the flip flop after a programmed predetermined amount of time to reset the alarm means thereby avoiding a continuous annoying alarm and preventing the alarm from continually activating if the receiving unit remains within the immediate vicinity of the emergency vehicle for an extended time, by not allowing reactivation until there has been a valid data stream for a predetermined amount of time.

11. A method as in claim 10 wherein the duration timer is a monostable generator.

12. A method as in claim 11 wherein the alarm means comprises an audible alarm and a flashing lamp.

13. A method as in claim 12 wherein the predetermined amount of time for the intermittent reactivation of the alarm means may be programmed independently of the prerequisite duration of a valid data stream so that if the receiving unit remains in the immediate vicinity of an emergency vehicle for an extended period of time the alarm may be deactivated for a longer period than the intermittent time.

14. A method as in claim 13 wherein the receiving unit is equipped with a cigarette lighter power connection.

* * * * *